US005453175A

United States Patent [19]

Newby

[11] Patent Number: 5,453,175

[45] **Date of Patent: * Sep. 26, 1995**

[54] PROTECTION OF LEAD-CONTAINING ANODES DURING CHROMIUM ELECROPLATING

[75] Inventor: Kenneth R. Newby, Berkeley Heights, N.J.

[73] Assignee: Elf Atochem N. A., Inc., Philadelphia, Pa.

[ * ] Notice: The portion of the term of this patent subsequent to Jan. 5, 2010 has been disclaimed.

[21] Appl. No.: 268,476

[22] Filed: Jun. 30, 1994

Related U.S. Application Data

[63] Continuation of Ser. No. 998,987, Dec. 31, 1992, abandoned, which is a continuation-in-part of Ser. No. 609,276, Nov. 5, 1990, Pat. No. 5,176,813, which is a continuation-in-part of Ser. No. 431,963, Nov. 6, 1989, abandoned.

[51] Int. Cl.[6] ..... C25D 3/10

[52] U.S. Cl. ..... 205/283; 205/284; 205/290

[58] Field of Search ..... 205/283, 284, 205/290

[56] References Cited

U.S. PATENT DOCUMENTS 5,176,813 1/1993 Newby ..... 205/284

*Primary Examiner*—John Niebling
*Assistant Examiner*—Brendan Mee
*Attorney, Agent, or Firm*—Stanley A. Marcus

[57] ABSTRACT

The present invention provides an improved method for electroplating chromium, using lead anodes, while achieving the advantages of using methanesulfonic acid without suffering the excessive anode-corrosion characteristics associated with that acid. Accordingly, chromium is electrodeposited from a bath containing chromic acid, sulfate ion and an alkylpolysulfonic acid containing from one to about three carbon atoms. The preferred alkylpolysulfonic acid is methanedisulfonic acid.

16 Claims, No Drawings

PROTECTION OF LEAD-CONTAINING ANODES DURING CHROMIUM ELECROPLATING

CROSS-REFERENCE TO RELATED APPLICATION

This application is a continuation of U.S. patent application Ser. No. 07/998,987, filed Dec. 21, 1982, now abandoned, which in turn is a continuation-in-part of my U.S. patent application Ser. No. 07/609,276, now U.S. Pat. No. 5,176,813 filed Nov. 5, 1990, which was, in turn, a continuation-in-part of my U.S. patent application Ser. No. 07/431,963, filed Nov. 6, 1989, and now abandoned.

BACKGROUND OF THE INVENTION

1. Field of the Invention

This invention is in the field of protecting lead anodes from corrosion during metal-electroplating processes. More particularly, this invention provides a method and composition for electroplating chromium, using lead or lead-containing anodes under conditions which produce adherent, bright chromium deposits at high efficiencies, where cathodic low-current-density etching is substantially reduced in comparison with existing high-efficiency catalyst systems. The invention further provides a composition for the replenishment of exhausted or depleted plating baths while diminishing anode corrosion.

2. Description of the Prior Art

Several advantages of certain short-chain alkylsulfonic acids in chromium electroplating have been described for both decorative and functional systems. U.S. Pat. No. 3,745,097 to Chessin, assigned to the same assignee as this invention, discloses decorative electroplating baths containing alkylsulfonic or haloalkylsulfonic acids in combination with certain carboxylic acids to produce bright, iridescent chromium surfaces on the articles plated. In U.S. Pat. No. 4,588,481, Chessin et al. further disclose functional chromium electroplating processes which use baths containing alkylsulfonic acids having a ratio of sulfur to carbon of ⅓ or greater, but free of carboxylic acids; the processes result in hard, adherent chromium deposits produced at elevated temperatures and high efficiencies without cathodic low-current-density etching. However, the chromium-plating baths taught by U.S. Pat. No. 4,588,481, while yielding the high-efficiency plating described in that disclosure, also resulted in severe problems of scale buildup on, and etching and corrosion of the anode. The disclosure of U.S. Pat. No. 4,588,481 specifies a variety of sulfonic acids, including methanesulfonic acid (MSA), ethanesulfonic acid (ESA), methanedisulfonic acid (MDSA) and 1,2-ethanedisulfonic acid (EDSA). Generally for economic reasons, MSA has become the agent of choice in a number of commercial embodiments for chromium plating which have appeared in the marketplace, even though severe scale buildup and anodic corrosion are encountered.

As noted hereinabove, when chromium-plating processes using MSA have been installed and utilized commercially, difficulty has arisen in functional plating using lead or conventional lead-alloy anodes; investigation into the matter of anode corrosion subsequent to the issuance of U.S. Pat. No. 4,588,481 has revealed that MSA in the plating baths generally causes the excessive corrosion of those anodes after extended operation, relative to the corrosion observed in conventional plating processes.

"Conventional plating processes" or "conventional baths" are defined herein as those which are conducted with a plating bath consisting of chromic acid and sulfate ion as the essential ingredients, the sulfate ion generally being provided by sulfuric acid or sodium sulfate, although those are not limiting sources, the requirement being solely that a soluble sulfate ion be provided. It has been found that as a lead anode is used repeatedly in functional chromium electroplating with baths containing MSA, the anode disintegrates at a faster rate than in conventional baths, and it must therefore be replaced much sooner than the anode in an analogous conventional bath. In this specification, the term "lead anode" is intended to define plating-bath anodes formed of lead or lead alloys commonly containing varying percentages of tin or antimony, either alone or in combination with other metals. In the nomenclature of the art, a term such as "Pb-7%Sn" is used to designate a tin-lead composition being primarily lead, and having about 7% tin by weight as the alloying metal. In such compositions, there may further be minor amounts of other materials present. Such materials are well known to those skilled in the art, and as such form no part of the invention described herein.

In my U.S. Pat. No. 4,786,378, I introduced bismuth, arsenic or antimony ion into the bath with MSA in an attempt to reduce anode corrosion. Thereafter, in U.S. Pat. No. 4,810,337, describing the use of sulfonic acids in electroplating processes, I further disclosed one treatment of the anode-corrosion problem described here in connection with the use of MSA. In that patent, I noted that a heavy scale deposit occurs in plating processes using MSA, and applied a relatively high voltage across the electrodes prior to the plating process in order to reduce the observed scale buildup and concomitant corrosion.

Another attempted solution to the problem has been the investigation of materials which are resistant to attack by bath compositions containing MSA. For instance, in German application 3,625,187A, filed on Jul. 25, 1986, anodes made of lead containing up to about 9% by weight of antimony or about 1% by weight of palladium, with or without small amounts of tin, silver and/or selenium are reported to show "good results" when used in functional chromium electroplating processes carried out at 55° C., with a cathodic current density in the range of 30 to 32 amperes per square decimeter ($A/dm^2$) and an anodic current density of from 25 to 30 $A/dm^2$ I have also investigated the effect of the purity of MSA on anode corrosion, on the supposition that impurities accompanying MSA might be at least a part of the problem. As noted in connection with Table II hereinbelow, this has been found not to be the case.

The foregoing publications and experimental work indicate at least in part the magnitude of the effect of anode scale and corrosion on plating, and the number and variety of approaches to its solution. However, until the evaluations leading to the present invention, workers in the art of chromium plating did not recognize that alkylpolysulfonic acids used as plating catalysts could both improve plating efficiency and decrease anode corrosion.

MSA and ESA have been generically identified as useful additives in plating baths for functional chromium-plating processes. However, as discussed hereinabove, the relevant references have indicated the problem of severe anodic corrosion when chromium is functionally electroplated for an extended period of time with lead anodes in plating baths containing MSA, the industry standard. Significantly, those references fail to suggest or disclose any particular means for an economical solution to the problem without sacrificing cost or process efficiency, or the other advantages obtained using baths containing MSA.

SUMMARY OF THE INVENTION

The present invention is an improvement in the method of electrodepositing chromium at a cathode efficiency of at least 20% at a current density of at least 11 A/dm$^2$ and at a plating temperature of about 40° to about 70° C. for a time sufficient to obtain a bright, adherent chromium deposit from an etch-free plating bath onto a basis-metal cathode with a lead anode in the substantial absence of a corrosion-producing monosulfonic acid by contacting the basis-metal cathode and the lead anode with a plating bath consisting essentially of chromic acid and sulfate ion in amounts sufficient to obtain the desired deposit of chromium, wherein the improvement comprises the inclusion in the bath of at least one alkylpolysulfonic acid, halogenated alkylpolysulfonic acid, or salt thereof.

As used herein, the term "substantial absence of a corrosion-producing monosulfonic acid" means the inclusion in the plating bath of amounts of one or more monosulfonic acids or salts, whether added to the bath or formed in situ, which acids or salts are insufficient to cause anode corrosion greater than that encountered in conventional plating baths.

DESCRIPTION OF THE PREFERRED EMBODIMENTS

The preferred embodiment of the present invention comprises the method of contacting a basis-metal cathode and a lead anode with a plating bath consisting essentially of chromic acid and sulfate ion in amounts sufficient to obtain a useful deposit of chromium, and at least one alkylpolysulfonic acid, halogenated alkylpolysulfonic acid, or salt thereof, which acid or salt contains from one to about three carbon atoms, and electrodepositing chromium at a cathode efficiency of at least 20%, at a current density of from about 11 to about 230 A/dm$^2$, and at a plating temperature from about 40° to about 70° C. for a time sufficient to obtain a bright, adherent chromium deposit.

The alkylpolysulfonic acids or salts useful in the method of the present invention have the formula $$R_a-[\underset{\underset{X_b}{|}}{C_n}-(SO_2OH)_y]_m,$$

where a and b are independently from 0 to 2, n is from 1 to 3, m and y are independently from 1 to 3, provided that the total number of sulfonic groups in the molecule is not less than 2, X is halogen or oxygen, R is unsubstituted lower alkyl or substituted lower alkyl, and when a is 2 can be the same or different, where the substituents on R are halogen or oxygen, and where hydrogen occupies any positions otherwise unaccounted for, i.e., to satisfy unfilled valences of carbon or oxygen.

Those skilled in the art will realize that the salts of this invention can be formed by the replacement of the labile hydrogen of the sulfonic group by a metal, such as, e.g., sodium, potassium, or the like, and that in any event, the ionic species of the sulfonate is present in the plating bath.

As set forth in the formula above, the alkylpolysulfonic acids of this invention contain at least two sulfonic acid groups connected to carbon, and any one carbon atom can have up to three sulfonic acids groups attached thereto. Preferred materials are alkyldisulfonic acids. In the most-preferred embodiment of the invention, the alkyldisulfonic acid is MDSA.

In the utility of the present invention, the polysulfonic acids are incorporated into a functional chromium-plating bath in substantially catalytic amounts. Within the scope and spirit of this invention, and depending upon plating conditions, that amount has been determined to be from about 0.25 to about 40 grams per liter (g/l), and preferably from about 1 to about 12 g/l, of an alkylpolysulfonic acid. Particularly preferred amounts range from about 2 to about 8 g/l.

The benefits of the present invention are obtained by the use in the plating bath of at least one material selected from the group consisting of alkylpolysulfonic acids containing from one to about three carbon atoms, halogenated alkylpolysulfonic acids, and salts of such acids and halogenated acids, which acids or salts contain from one to about three carbon atoms. Halogenated acids are those containing fluorine, chlorine, bromine or iodine bound to a carbon atom; fluorine- and chlorine-substituted derivatives are preferred. Representative acids and salts include MDSA, mono- and dichloromethanedisulfonic acid, 1,1-ethanedisulfonic acid, and monochloro- or 1,2-dichloro- 1,1,-ethanedisulfonic acid and their salts, provided that there is no precipitation of chromium or sulfate moieties caused by the addition of the salt. Preferred cations are chosen from alkali metals. Particularly preferred salts are those of sodium and potassium. Those skilled in the art will understand that alkylpolysulfonic acids, halogenated alkylpolysulfonic acids or their salts will be present in the ionic form in the plating bath; these materials are hereinafter referred to generically as "alkylpolysulfonic acids."

The functional electroplating process is generally carried out at plating temperatures from about 40° to about 70° C., although plating at temperatures from about 50° to about 60° C. is within the scope and spirit of this invention. Current densities of from about 11 to about 230 A/dm$^2$ are suitable in the process of this invention, while densities of from about 30 to about 150 A/dm$^2$ are preferred, and from about 50 to about 100 A/dm$^2$ are most preferred. Plating efficiencies of at least 20% are easily achieved, with values of from about 22 to about 28% being typical under the described most-preferred conditions.

In the course of attempting to reduce anode corrosion in chromium-plating processes, it has surprisingly been discovered that substantial replacement of MSA by certain alkylpolysulfonic acids, in chromium electroplating baths for use with lead anodes, dramatically reduces the amount of anode corrosion without sacrificing plating efficiency or chromium adherence. Specifically, the use of the alkylpolysulfonic acids of the present invention enables the efficient production of useful chromium-plated items; i.e., those whose characteristics are at least as good as those obtained in the course of high-efficiency baths of the prior art, but without the deleterious corrosion of the lead anodes encountered with high-efficiency baths of the prior art.

As used in this specification, "excessive corrosion" is that amount of corrosion perceptibly greater than the corrosion observed in conventional plating processes using no sulfonic acid. "Extended" use is the amount of use of a lead anode in a conventional system which leads to detectable corrosion of that anode.

"Efficient functional electrodeposition" means electrodeposition of chromium at generally higher current efficiencies than those obtained with conventional plating baths, and occurs with the present invention, for example, at cathode efficiencies of at least 20% at 30 A/dm$^2$ and 55° C. A "corrosion-inhibiting amount" of added bath material is that amount which provides enhanced plating efficiency over conventional plating baths while avoiding electrolytic or chemical attack at an electrode.

This invention provides a method which is useful to produce bright, adherent chromium deposits at high efficiencies, but which substantially avoids the excessive anode corrosion which is characteristic of industrial baths containing MSA, wherein the bath with the present inventive method consists essentially of chromic acid and sulfate in amounts sufficient to obtain efficient functional electrodeposition, and at least one alkylpolysulfonic acid containing from one to about three carbon atoms, and the bath is substantially free of monosulfonic acids. As used herein, the term "substantially free", when applied to monosulfonic acids, is chosen to mean a concentration of monosulfonic acid sufficiently low to avoid a detectable rate of corrosion, that rate being higher than the rate of corrosion experienced in a conventional plating bath consisting essentially of chromic acid and sulfate ion, where the chromic acid and sulfate are used in amounts sufficient to obtain a useful deposit of chromium.

Useful chromic acid amounts in the method of this invention range from about 100 to about 450 g/l; preferred ranges are from about 200 to about 300 g/l. Sulfate ion is used in amounts ranging from about 1 to about 5 g/l, and preferably ranging from about 1.5 to about 3.5 g/l.

The electroplating baths may include other ingredients which do not substantially affect process efficiency, chromium adherence, or brightness in a negative manner. Such additives, known to those skilled in the art, may be incorporated to improve handling of the baths, such as, e.g., fume suppressants, brightening agents and the like, and form no part of this invention as such.

The functional electroplating method of the present invention includes a lead anode, a cathode generally comprising a workpiece for plating, and the chromium electroplating bath as described herein. Typical cathode items include crankshafts, piston rings and the like. As previously noted, typical anode materials include substantially pure lead, but are more generally alloys containing lead in combination with tin, antimony, tellurium and a variety of other metals, either singly or in combination.

The utility of this invention is shown by the following examples, which are illustrative rather than limiting:

EXAMPLE 1

Accelerated anode-corrosion tests were conducted, using previously weighed Pb-7%Sn anodes in several different chromium-plating baths as described here:

(a) a conventional chromium-plating bath (chromic-acid-:sulfate-ion ratio of 100:1);

(b) an analogous bath containing chromic acid, sulfate ion and MSA; and (c) a bath according to the present invention, containing MDSA as a representative disulfonic acid in place of MSA.

Extended bath usage was simulated by plating at 60° C. at an anode current density of 0.5 A/dm$^2$ for 30 minutes, followed by 30 minutes of non-plating. This process was conducted for about eight hours, and the power then turned off overnight, during which time the bath was allowed to cool. These steps were repeated for a period of several weeks; the anodes were occasionally removed, dried, weighed and then re-inserted into the bath. The results are given in Table I.

TABLE I

| | Electroplating Bath | Anode Weight Loss (g) 600 amp-hours | 1605 amp-hours |
|---|---|---|---|
| (a) | Conventional (250 g/l chromic acid; 2.5 g/l sulfate ion) | 13.32 | 37.33 |
| (b) | MSA (bath [a] with 3.0 g/l MSA) | 16.29 | 41.77 |
| (c) | MDSA (bath [a] with 3.2 g/l MDSA/Na salt) | 13.41 | 37.31 |

It is seen that in bath (c), containing MDSA as set forth herein for use in the process of this invention, anode corrosion remains substantially at the level of the conventional chromium-plating bath (a), whereas bath (b), with MSA as the plating-improvement medium, leads to corrosion at a substantially higher rate. In bath (b), there was evidence of serious interfacial attack on the anode, while in the conventional bath (a) and inventive bath (c), the appearance of the anode was substantially unaffected by the plating process. The quality of the deposit obtained with the inventive bath was at least as good as, and somewhat harder than, the plating achieved with either the conventional commercial plating bath or that containing MSA.

EXAMPLE 2

In a second type of accelerated test, a measured direct current was applied to the Pb-7% Sn anode in bath solutions deliberately kept low in chromic acid and high in MSA or MDSA. The percentage of current which formed soluble products (i.e., the percentage of current leading to corrosion) was determined by measuring actual anode weight loss, and dividing that value by the weight loss predicted by Faraday's Law; this calculation assumed that all weight loss resulted from the corrosion reaction Pb→Pb(II). The results are shown in Table II.

TABLE II

Effects of MSA and MDSA on Anode Corrosion

| Material | Concentration, Moles/Liter 0.13 | 0.25 |
|---|---|---|
| | Current, Percent | |
| Chromic Acid, 100 g/l (control) | 0.61 | 0.61 |
| 70% assay MSA | 1.64 | 3.40 |
| 99.9% assay MSA, sample 1 | 1.72 | 5.79 |
| ESA | 2.29 | 3.81 |
| 1-Propanesulfonic acid | 3.18 | 5.76 |
| 1-Butanesulfonic acid | 6.30 | 5.56 |
| Methanedisulfonic acid disodium salt | 0.72 | 0.79 |
| 1,2-Ethanedisulfonic acid sodium salt | 0.55 | 0.35 |
| 2-Propanesulfonic acid sodium salt | 1.90 | 3.67 |
| 2-Chlorosulfonic acid sodium salt monohydrate | 1.55 | 3.19 |
| 2-Ketopropane-1,3-disulfonic acid dipotassium salt | 0.51 | — |

It will be observed from a consideration of the foregoing table that the teaching of a sulfur-to-carbon ratio of ⅓ in Chessin et al. in U.S. Pat. No. 4,588,481 is in fact overbroad.

Both the ethane- and propanesulfonic acids, although adequate plating catalysts falling squarely within the disclosed limits of Chessin et al., also promote unacceptable levels of corrosion in chromium-plating baths.

To determine the efficacy of the method of this invention in providing long anode life, 26 new, conventional electroplating anodes; i.e., Pb-6%Sb, were used in a field trial lasting for 41 months. In that trial, the anodes were used for plating chromium from baths containing chromic acid from about 100 to about 450 g/l, sulfate ion from 1 to about 5 g/l, and MDSA from 1 to about 12 g/l. Each anode was stamped with a sequential number, and weighed prior to its placement in the solution.

From time to time after their installation, individual anodes were weighed and found to have lost only a small amount of their original mass while operating as anodes in a plating bath having MDSA as a plating catalyst. No pits or other signs of corrosion appeared on the anodes.

Some anodes were removed from the operation from time to time for interim analysis. At the end of the 41-month period, each of the remaining anodes was weighed and inspected. No signs of pitting or uneven wear were seen. The results of the determination of the 19 anodes which were used for the full test period are shown in Table III; all weights are in kilograms.

TABLE III

Anode Weight Loss in 41 Months of Plating Operations

| Anode # | Original Weight | Final Weight | Loss, % |
|---|---|---|---|
| 1 | 10.52 | 10.02 | 4.7 |
| 2 | 10.61 | 10.16 | 4.3 |
| 3 | 10.61 | 10.16 | 4.3 |
| 4 | 10.66 | 8.53 | 20.0 |
| 5 | 19.66 | 10.43 | 2.1 |
| 6 | 10.52 | 9.12 | 13.4 |
| 7 | 10.66 | 9.25 | 13.2 |
| 10 | 10.52 | 8.21 | 22.0 |
| 11 | 10.66 | 7.30 | 31.5 |
| 14 | 10.61 | 8.35 | 21.4 |
| 15 | 10.52 | 8.35 | 20.7 |
| 16 | 10.52 | 8.80 | 16.4 |
| 17 | 10.52 | 8.80 | 16.4 |
| 18 | 10.61 | 9.25 | 12.8 |
| 20 | 10.61 | 8.35 | 21.4 |
| 23 | 10.52 | 8.62 | 18.1 |
| 24 | 10.52 | 7.76 | 26.3 |
| 25 | 10.61 | 10.02 | 5.6 |
| 26 | 10.61 | 8.21 | 22.6 |
| Average | 10.57 | 8.94 | 15.4 |

Based on the results of the determination reported in Table III, the average weight loss of this group was 4.5% per year. Substantially identical anodes used with MSA as a plating catalyst of the prior art, under substantially similar plating conditions, have lasted less than five or six months, and more often, only about four months.

A further utility of this invention lies in the continued high efficiency of the anodes, whereas the anodes in the baths of the prior art, near the ends of their effective lives, would have undergone a substantial loss of mass and anode surface, and therefore a concomitant loss of efficiency in carrying plating current.

From consideration of the foregoing discussion, those skilled in the art will understand that conventional anodes used with the high-energy-efficiency plating catalyst of the present invention last at least seven, and up to more than ten, times longer than those used with the catalyst of the prior art, and provide more efficient current transfer over their lives than do those in prior-art baths.

These results also demonstrate that corrosion of the anode in the presence of MDSA is substantially the same as the conventional bath without MSA, whereas the presence of MSA, while improving plating efficiency, also causes significantly increased anode corrosion.

This invention has further utility as a replenishment composition for existing operations. Specifically, a composition consisting essentially of chromic acid in amounts sufficient to replenish what has been consumed in plating, and at least one alkylpolysulfonic acid, is useful for addition to a functional chromium-plating installation to improve plating efficiency with concomitant decrease in anode corrosion, even where the existing installation is operating with baths of the prior art.

In particular, utility in accordance with this invention has been found in a replenishment composition for a chromium-plating bath having chromic acid and at least one alkylpolysulfonic acid, in amounts from about 1 to about 40 g per kilogram (kg) of $CrO_3$, and preferably from about 2 to about 25 g per kg, of replenishment composition. This composition can be either a solid mixture or a solution. Those skilled in the art will realize that the chromium can be present as the oxide, the acid or a salt, and that the amount of chromium is calculated and expressed for convenience as $CrO_3$, irrespective of the exact nature of the chromium-containing material present.

Modifications and improvements to the preferred forms of the invention disclosed and described herein may occur to those skilled in the art who come to understand the principles and precepts hereof. Accordingly, the scope of the patent to be issued hereon should not be limited solely to the embodiments of the invention set forth herein, but rather should be limited only by the advance by which the invention has promoted the art.

What is claimed is:

1. In the method of electrodepositing chromium at a cathode efficiency of at least 20% utilizing a lead anode, a current density of at least 11 A/dm$^2$ and a plating bath containing chromic acid, sulfate, and an alkylsulfonic acid, said process characterized by corrosion of the lead anode, the improvement which comprises replacing at least part of the alkylsulfonic acid with an alkyldisulfonic acid, halogenated alkyldisulfonic acid or salt thereof, whereby corrosion of the lead anode is substantially reduced.

2. The method according to claim 1 wherein the alkyldisulfonic acid, halogenated alkyldisulfonic acid, or salt is selected from the group consisting of methanedisulfonic acid, mono- and dichloroethane-1,1-disulfonic acid, 1,1-ethanedisulfonic acid, and mono- and dichloromethanedisulfonic acid and salts thereof.

3. The method according to claim 1 wherein the alkyldisulfonic acid, halogenated alkyldisulfonic acid, or salt is present in the bath in an amount from about 0.25 to about 40 g/l.

4. The method according to claim 3 wherein the amount is from about 1 to about 12 g/l.

5. The method according to claim 3 wherein the amount is from about 2 to about 8 g/l.

6. The method according to claim 1 wherein the alkyldisulfonic acid is methanedisulfonic acid.

7. The method according to claim 6 wherein the methanedisulfonic acid is present in an amount from about 0.25 to about 40 g/l.

8. The method according to claim 6 wherein the methanedisulfonic acid is present in an amount from about 1 to about 12 g/l.

9. The method according to claim 6 wherein the methanedisulfonic acid is present in an amount from about 2 to about 8 g/l.

10. The method according to claim 1 wherein the amount of chromic acid in the plating bath is from about 100 to about 450 g/l.

11. The method according to claim 1 wherein the amount of chromic acid in the plating bath is from about 200 to about 300 g/l.

12. The method according to claim 1 wherein the plating temperature is from about 50° to about 60° C.

13. The method according to claim 1 wherein the amount of sulfate ion is from about 1 to about 5 g/l.

14. The method according to claim 1 wherein the amount of sulfate ion is from about 1.5 to about 3.5 g/l.

15. The method according to claim 1 wherein the current density is from about 30 to about 150 $A/dm^2$.

16. The method according to claim 1 wherein the current density is from about 50 to about 100 $A/dm^2$.

* * * * *

UNITED STATES PATENT AND TRADEMARK OFFICE

CERTIFICATE OF CORRECTION

PATENT NO. : 5,453,175
DATED : September 26, 1995
INVENTOR(S) : Kenneth R. Newby It is certified that error appears in the above-indentified patent and that said Letters Patent is hereby corrected as shown below:

On the title page, Item [54], change "ELECROPLATING" to — ELECTROPLATING —.

Signed and Sealed this

Thirteenth Day of February, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,453,175
DATED : September 26, 1995
INVENTOR(S) : Kenneth R. Newby It is certified that error appears in the above-indentified patent and that said Letters Patent is hereby corrected as shown below:

On the title page, item [73] should read: Atotech USA, Inc.

Signed and Sealed this

Twenty-ninth Day of April, 1997

*Attest:*

Bruce Lehman

BRUCE LEHMAN

*Attesting Officer*

*Commissioner of Patents and Trademarks*